US005963411A

United States Patent [19]

Mollet et al.

[11] Patent Number: 5,963,411

[45] Date of Patent: Oct. 5, 1999

[54] COMPACT FOCUSED DISCONNECT DEVICE

[75] Inventors: Ronald Mollet, Ellisville; Thomas C. Stevens, Maryland Heights, both of Mo.

[73] Assignee: Cooper Technologies Company, Houston, Tex.

[21] Appl. No.: 09/084,963

[22] Filed: May 27, 1998

[51] Int. Cl.[6] ..... H01H 85/50

[52] U.S. Cl. ..... 361/104; 337/213

[58] Field of Search ..... 361/103, 104; 337/194, 186, 196, 206, 208, 211, 213; 439/620, 621

[56] References Cited

U.S. PATENT DOCUMENTS

D. 336,073 6/1993 Happ .
D. 346,791 5/1994 Marach et al. .
D. 348,048 6/1994 Marach et al. .
D. 355,642 2/1995 Marach et al. .
D. 355,893 2/1995 Marach et al. .
D. 367,041 2/1996 Alfaro et al. .
D. 370,662 6/1996 Alfaro .

*Primary Examiner*—Albert W. Paladini
*Assistant Examiner*—Kim Huynh
*Attorney, Agent, or Firm*—Armstrong Teasdale LLP

[57] ABSTRACT

A power supply disconnect device includes a main housing that fits within a power supply distribution panel; a receptacle in the main housing; a detachable fuse holder that fits within the main housing receptacle; first electrical contacts within the main housing that are engagable with a fuse in the fuse holder when the fuse holder is inserted in the main housing receptacle; the fuse holder includes two parts that are moveable relative to each other, and which can be moved into an open position for receiving the fuse and into a closed position for securing the fuse in the fuse holder; and an alarm fuse connected to the first electrical contacts so as to provide an alarm in the event that a fuse in the fuse holder is blown, the alarm fuse being located in the receptacle in the main housing.

19 Claims, 5 Drawing Sheets

COMPACT FOCUSED DISCONNECT DEVICE

BACKGROUND OF THE INVENTION

1. Field of the Invention

The present invention relates to fused disconnect devices for electrical power distribution systems, and in particular, for low voltage, high current telecommunications applications.

2. Related Art

U.S. Pat. No. 5,355,274 discloses a fused disconnect device 100. The disclosed device includes a housing 130, 730 and a fuse holder 400, 702 which is insertable into the housing. In the disclosed device, the fuse is retained within the fuse holder 400, 702 by electrical contacts 410, 414, 706, 708 that make electrical contact with the fuse, and which mechanically secure the fuse within the fuse holder 400, 702. The electrical contacts of the fuse carrier 400, 702 then engage with electrical contacts 178, 180, 744, 746 within the main body 130, 730.

Thus, there are two sets of contacts. A first set of contacts is secured within the fuse carrier, and which is used to make electrical contact with the fuse. The first set of contacts are also frequently used to secure the fuse within the fuse carrier. A second set of electrical contacts is included in the main body, and is used to make electrical contact with the first set of contacts in the fuse holder. The use of two sets of electrical contacts creates inefficiencies in materials, as well as in the conduction of electric current. Specifically, a connection is required between the fuse contacts and the first set of contacts, and a second connection is required between the first set of contacts and the second set of contacts. Each connection creates potential electrical inefficiencies.

In addition, as can be seen from FIGS. 8 and 19 of the '274 patent, it is difficult to insert the fuse into the contacts of the fuse holder because the contacts of the fuse holder must strongly embrace the contacts of the fuse in order to make a satisfactory electrical connection. In many applications, particularly high current applications, the tight fit between the fuse contacts and the contacts with the fused device make it difficult to install the fuse in the disconnect device.

The disclosed fused disconnect device also includes an alarm fuse 516 that is located at a longitudinal end of the fuse. See, e.g., FIG. 1. Placing the alarm fuse at the longitudinal end of the fuse results in an unnecessarily long main body 130. In addition, the wiring of the alarm fuse is difficult from this position.

OBJECTS AND SUMMARY

It is an object of the present invention to provide a compact, high current fused disconnect device in which it is relatively easy to insert a fuse.

It is yet another object of the present invention to provide a fused disconnect device that includes an alarm fuse and a convenient, compact location.

It is yet another object of the present invention to provide a fused disconnect device that has a minimum number of electrical contacts for connection to conduct electricity from the line to the load.

A power supply disconnect device according to the present invention includes a main housing that fits within a power supply distribution panel; a receptacle in the main housing; a detachable fuse holder that fits within the main housing receptacle; first electrical contacts within the main housing that are engagable with a fuse in the fuse holder when the fuse holder is inserted in the main housing receptacle; and the fuse holder includes two parts that are moveable relative to each other, and which can be moved into an open position for receiving the fuse and into a closed position for securing the fuse in the fuse holder.

The power supply disconnect device according to the present invention also includes a main housing that fits within the power supply distribution panel; a receptacle in the main housing; a fuse holder that fits within the main housing receptacle; first electrical contacts within that main housing that are engagable with a fuse in the fuse holder when the fuse holder is inserted in the main housing receptacle; and an alarm fuse connected to the first electrical contacts so as to provide an alarm in the event that a fuse in the fuse holder is blown, the alarm fuse being located in the receptacle in the main housing.

The present invention also contemplates a method of installing a fuse in a power supply distribution panel having at least one power supply bus, the method comprising opening a fuse holder; inserting a fuse into the fuse holder; closing the fuse holder so as to secure the fuse within the fuse holder; and inserting the fuse holder into a receptacle of a disconnect device main housing so that contacts in the receptacle directly engage blades of the fuse in the fuse holder.

DETAILED DESCRIPTION OF THE PREFERRED EMBODIMENTS

Figure 6:
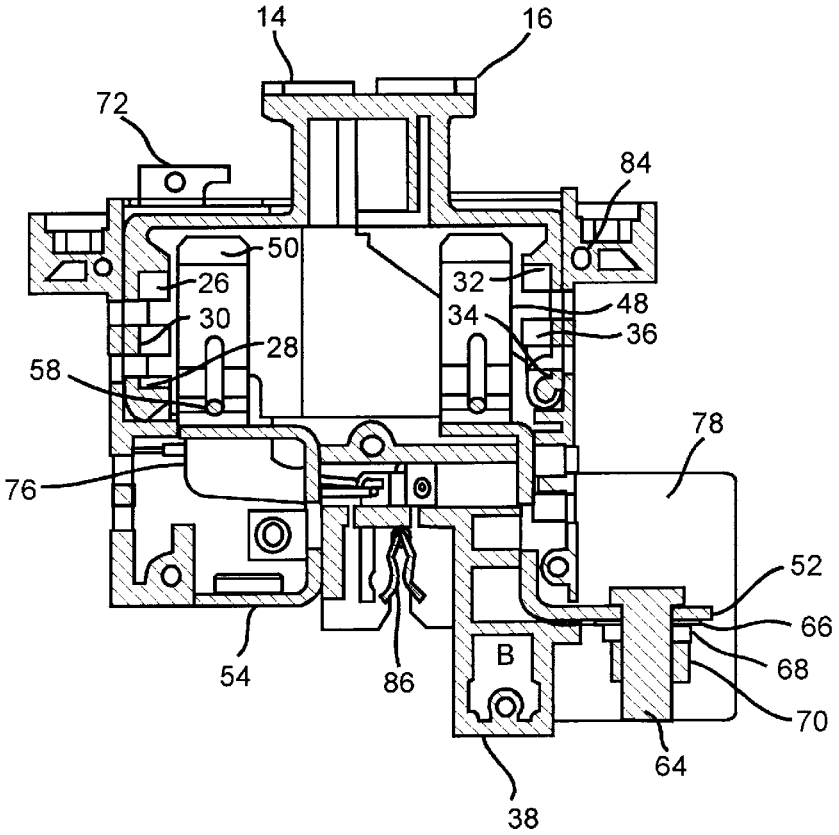
FIG. 6 is a cross section taken along lines 6—6 of FIG. 4.
Figure 1:
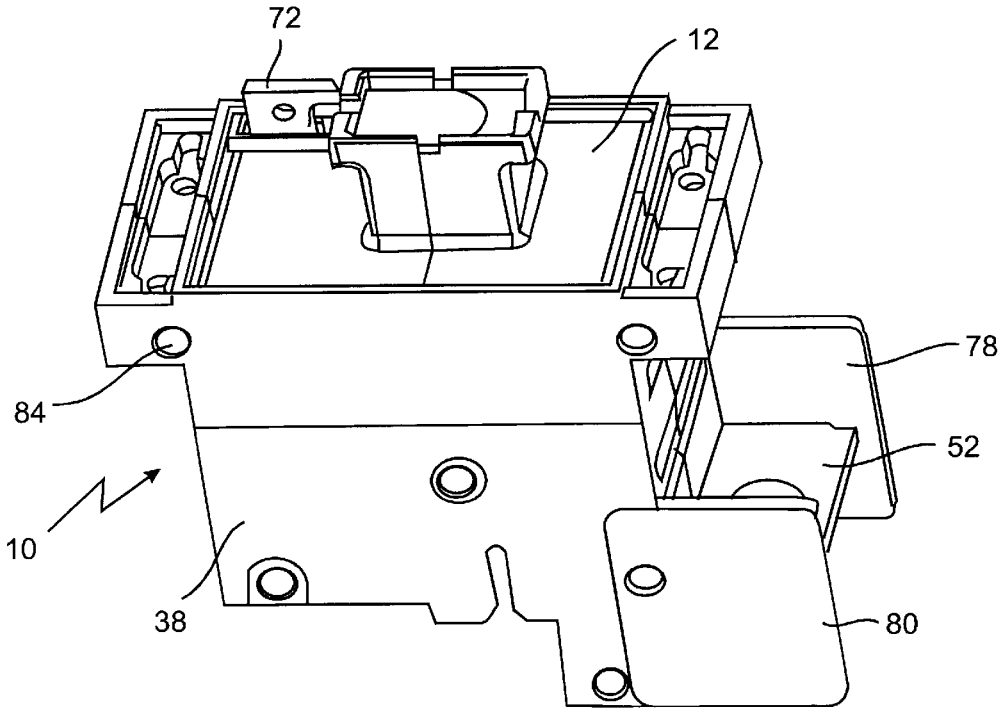
FIG. 1 is a perspective view of a fused disconnect device of the present invention.

The invention will now be described by reference to the drawing figures. The same reference numerals have been used throughout the drawings to identify the same elements.

A fused disconnect device 10 includes a fuse holder 12 and a main housing 38. The present invention is intended to be used with a knife blade fuse (not shown), such as a BUSSMANN® TPL fuse rated for 70 to 250 amps and 65 volts DC. However, other types, shapes, or sizes of fuses may be used.

Figure 2:
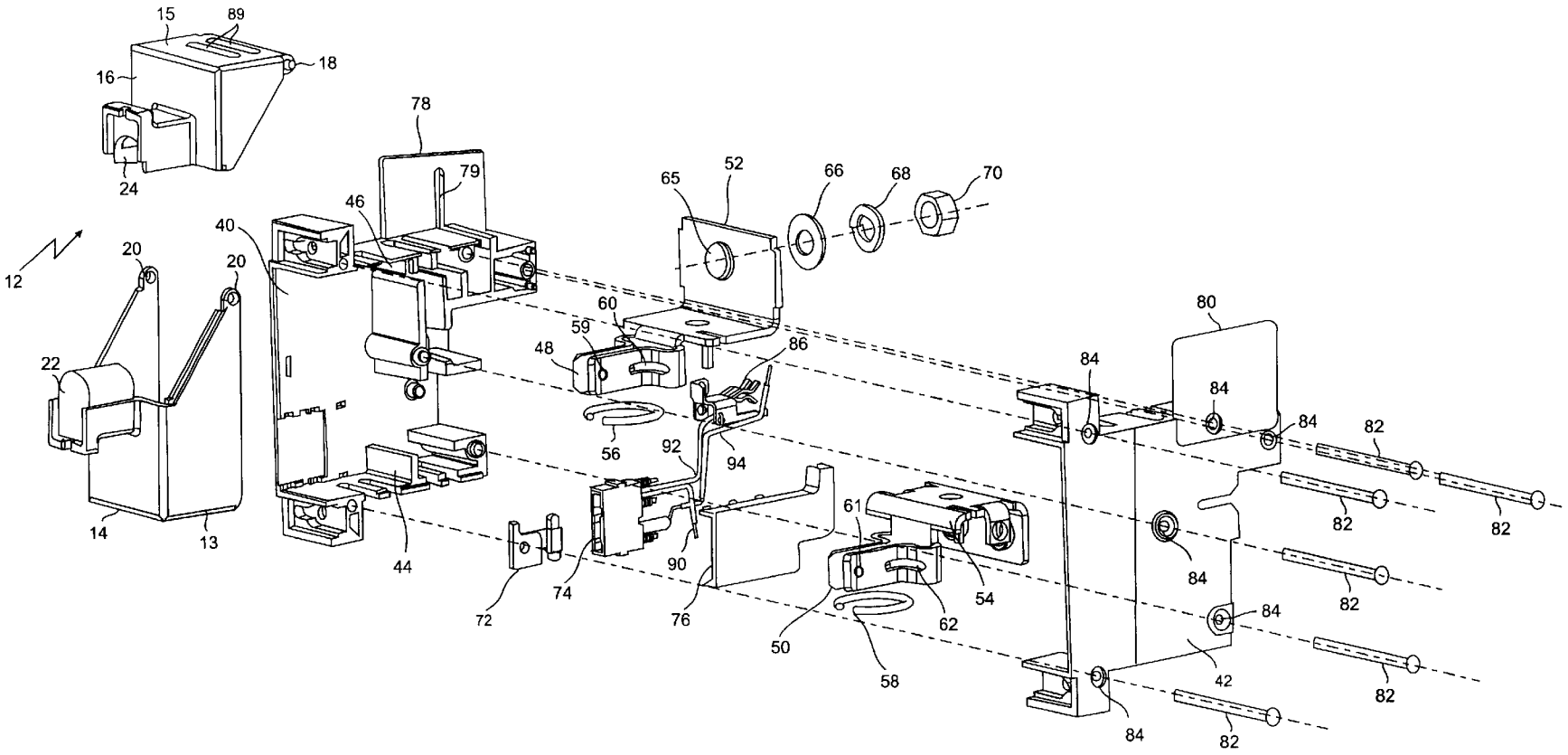
FIG. 2 is an exploded view of the fused disconnect device of the present invention.

As can be seen in FIG. 2, the fuse holder 12 includes a first half 14 and a second half 16. The second half 16 includes a hinge 18 extending along one end thereof that fits within apertures 20 on the first half 14.

Accordingly, the first half 14 and the second half 16 are pivotally connected by the hinge 18 and apertures 20. The first half 14 further includes a clasp 22 which fits within a similarly shaped recess 24 on the second half. The clasp 22, 24 create a friction fit which holds the fuse holder 12 in the closed position.

In an alternative embodiment, the two halves of the fuse holder may not necessarily be hinged together. They may be connected by some other mechanism, including but not limited to a telescoping arrangement, a snap fit, a tongue and groove arrangement, detents and recesses, or a gate that slides within a slot.

On the inside of each longitudinal end wall 13, 15 of the fuse holder 12 are brackets comprising shoulders 26, 28, 32, 34 and middle brackets 30, 36. The brackets engage with the ends of blades of a knife blade fuse. When the fuse holder 12 is in the closed position, as can be seen, e.g., in FIG. 6, the fuse is securely held within the fuse holder 12 by the brackets 26, 28, 30, 32, 34, 36.

The size and location of the brackets within the end walls 13, 15 can function as a rejection feature to prevent the insertion of a different size fuse that may have an incorrect rating. Thus, different fuse holders can be used having different arrangements of internal brackets for accepting different sized fuses.

Each end wall of the fuse holder 12 may include ventilation slots 89 in order to allow heat to escape from the fuse holder 12 during high current applications.

In order to insert a fuse into the fuse holder 12, or replace a fuse already in the fuse holder 12, the fuse holder 12 is removed from the main housing 38 and opened. If the fuse holder 12 is the embodiment illustrated in the figures, it is opened by pivoting the two halves about pin 18. Once opened, one end of the fuse is inserted into the first half 14 such that the end of the leading fuse blade is secured within brackets 26, 28, 30. The second half 16 of the fuse holder 12 is then pivoted into the closed position, and in the process, brackets 32, 34, 36 engage with and support the remaining blade of the fuse so as to secure the fuse within the fuse holder 12. The clasp 22, 24 retains the fuse holder 12 in the closed position until it is manually opened.

Because there are no electrical contacts in the preferred embodiment of the fuse holder 12, there is no need for the brackets 26, 28, 30, 32, 34, 36 to grasp the fuse in a particularly tight grip. It is sufficient that the fuse is grasped so that it does not rattle unnecessarily or fit loosely within the fuse holder 12. The primary requirement is that the fuse is retained in such a manner so that it is oriented properly when the fuse holder 12 is inserted in the main housing 38. As a result, it is not difficult to secure the fuse within the fuse holder 12.

The fuse holder 12 may be made of any acceptable material, which can be determined by one of skill in the appropriate art. In a preferred embodiment, the material from which the fuse holder 12 is made is RYNITE® FR515, which is a flame-retardant, GLASS REINforced thermoplastic polyester material, available from the DuPont Corporation of Wilmington, Del.

The main housing 38 includes a receptacle 40 into which the fuse holder 12 can be inserted, when the fuse holder 12 is in the closed position. The receptacle 40 includes shoulders 44, 46 for supporting the base of the fuse holder 12.

Mounted within the main housing 38 are two electrical contacts 48, 50. The electrical contacts are located such that when the fuse holder 12 is properly inserted into the receptacle 40 of the main housing 38, the blades of the knife blade fuse secured in the fuse holder 12 are engaged with the electrical contacts 48, 50.

The electrical contact 48 is connected to lug 52 for securement to a load. The electrical contact 50 is connected to a lug 54 for connection to the power line. The electrical contacts 48, 50 include elongated apertures 60, 62. A circular spring 56, 58 is inserted through each of the apertures 60, 62 and an end of each of the springs is secured in recesses 59, 61 at the end of the contacts 48, 50.

By passing the springs 56, 58 through the apertures 60, 62 in the electrical contacts 48, 50, a compact and simple means of applying pressure on the electrical contacts 48, 50 is achieved. This pressure assures an adequate contact and electrical connection between the contacts 48, 50 and the blade contacts of the knife blade fuse secured in the fuse holder 12.

Although the springs 56, 58 maintain the electrical contacts 48, 50 in secure engagement with the fuse contacts, it is not difficult to insert the fuse into the contacts 48, 50 because the fuse is retained within the fuse holder 12. Thus, when the fuse is inserted into the contacts, the operator is holding the fuse holder 12, not the fuse itself. Since it is easier to grip the fuse holder 12 than the fuse, insertion of the fuse into the main housing is made easier.

A post 64 extends through an aperture 65 in the load lug 52, and is secured thereto with a washer 66, a split washer 68, and a nut 70. To connect the disconnect device 10 to the load, a line from the load is secured to the post 64 with the washer 66, split washer 68, and nut 70. Of course, other means of connecting the load to the disconnect device 10 may be used.

Figure 7:
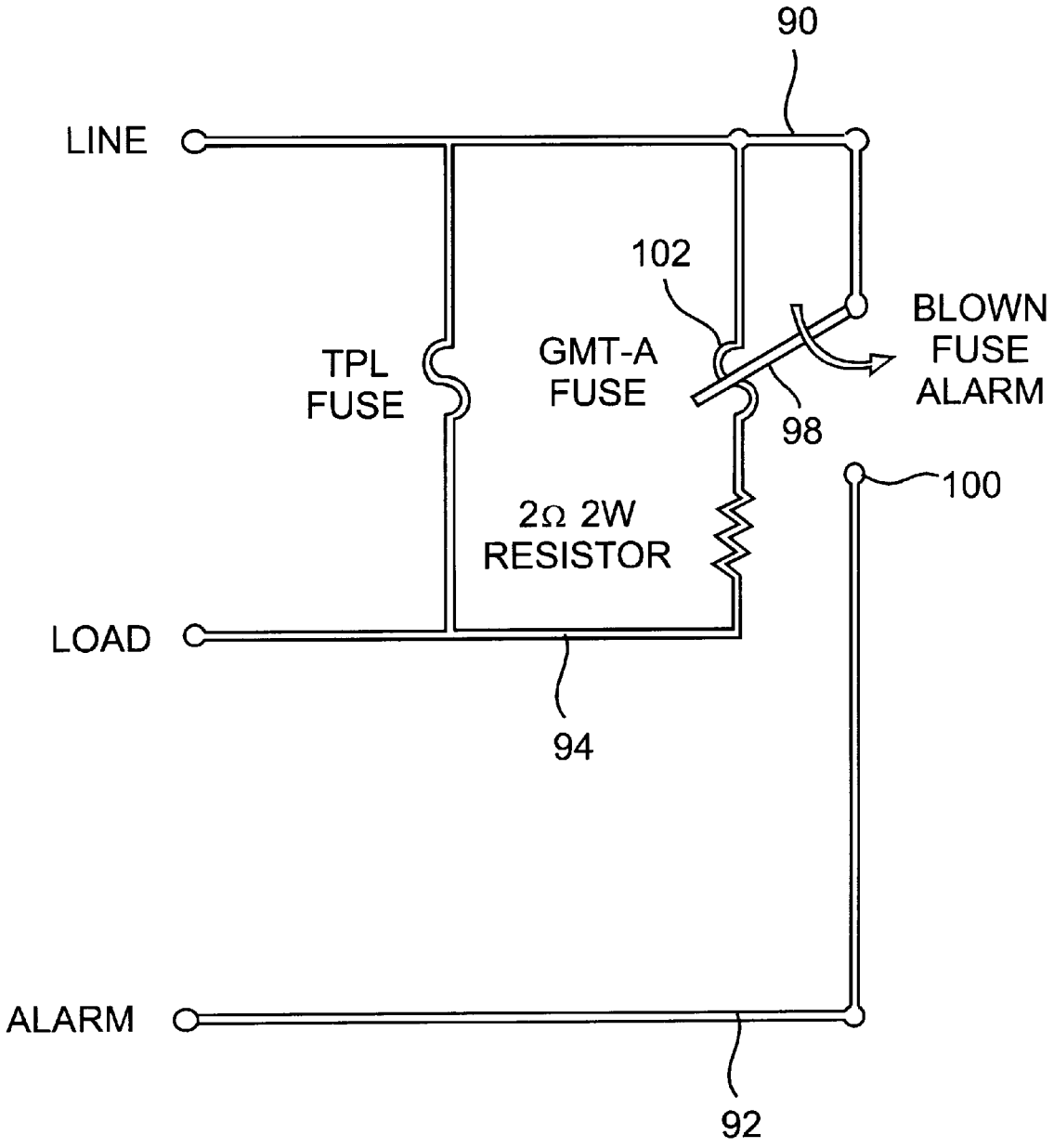
FIG. 7 is a wiring diagram showing the relationship between the alarm fuse and the main fuse.
Figure 8:
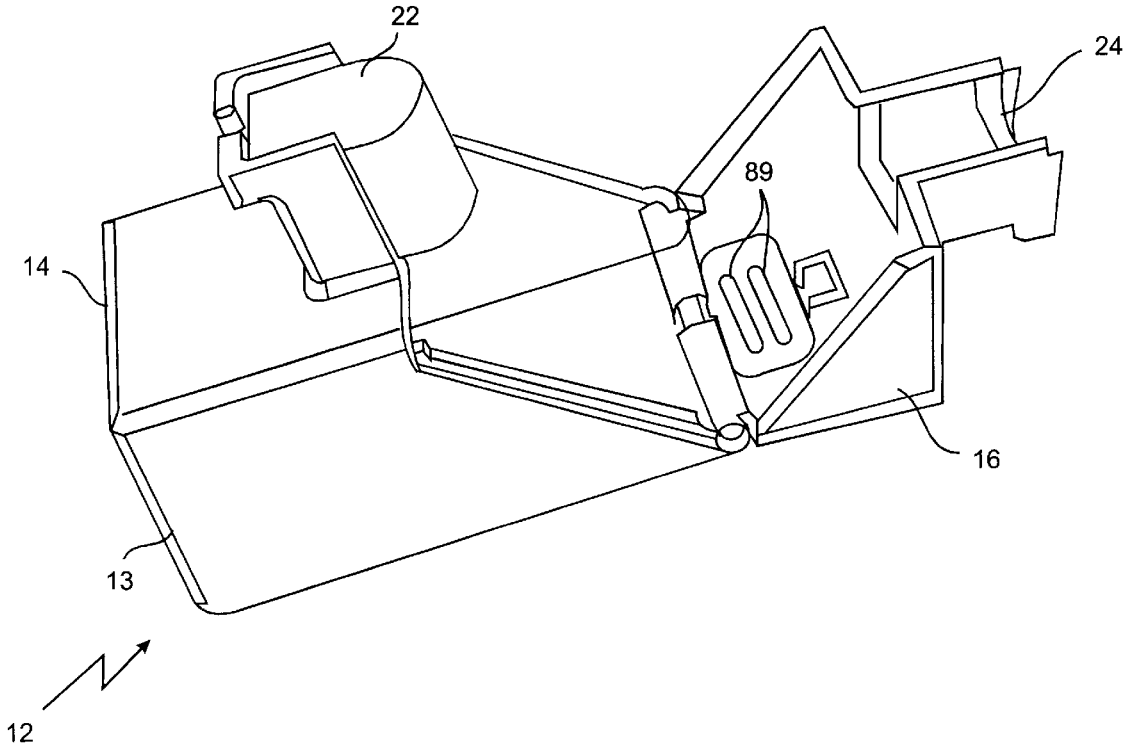
FIG. 8 is a perspective view of a fuse holder according to the present invention.

An alarm fuse 72 is secured in an alarm fuse holder 74, which is secured with a housing 76 against one edge of the receptacle 40. The alarm fuse may be any type alarm fuse. However, in a preferred embodiment, the alarm fuse is a BUSSMANN® GMT alarm fuse. According to FIG. 7, the alarm fuse 72 includes a biased contact arm 98 that is secured in a position away from a contact 100 by a fusible link 102 that is wired in parallel to the main fuse. A resistor 104 may be in series with the fusible link 102. An opposite end of the contact arm 98 is connected to the power line by wire 90. The contact 100 is connected to an alarm contact 86 on the main housing 38, so that when the main fuse is opened, all of the power is diverted from the main fuse through the alarm fusible link 102. The alarm fusible link 102 is very weak and intended to melt immediately when the main fuse is open. When the alarm fusible link 102 melts, the biased contact arm 98 is urged into contact with contact 100, thus completing a circuit between the power line and the alarm fuse contact 86. A remote indicator can be connected to the alarm fuse contact 86 to provide a remote indication when the main fuse opens.

In addition, the alarm fuse 72 is constructed such that a visible indication appears when the alarm fuse 72 is opened. Thus, the disconnect device 10 includes both local and remote indications of an open fuse.

By locating the alarm fuse 72 within the housing receptacle 40, the wiring of the alarm fuse 72, with wires 90, 92, 94, is more convenient and compact than if the alarm fuse 72 were situated outside of the receptacle 40 at a longitudinal end of the housing 38.

Figure 3:
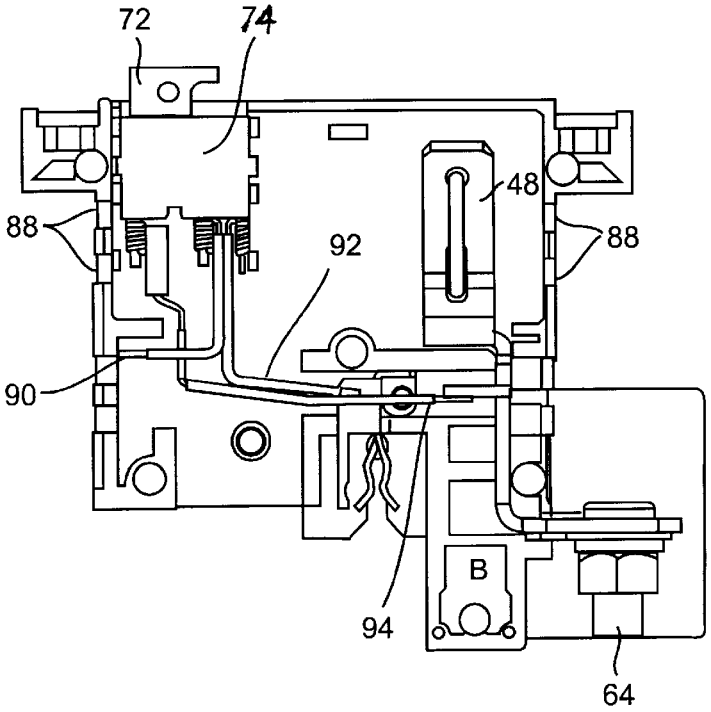
FIG. 3 is a view of a partially assembled device according to the present invention.
Figure 4:
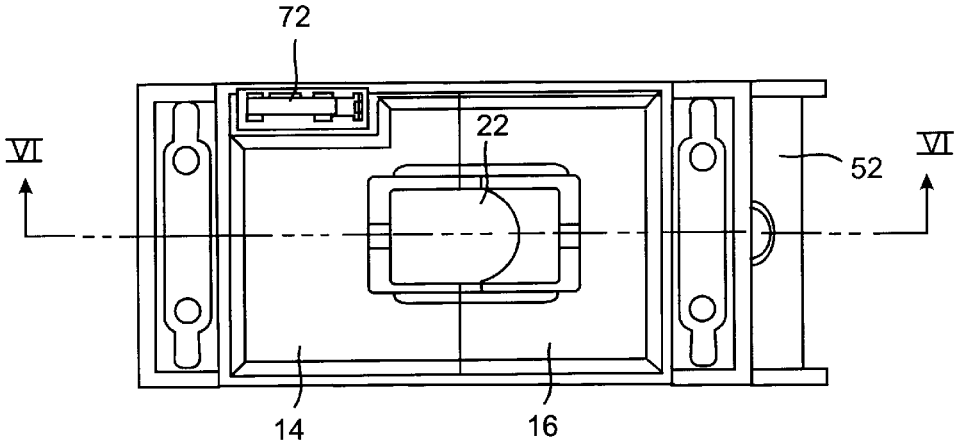
FIG. 4 is a top plan view of the disconnect device of the present invention.
Figure 5:
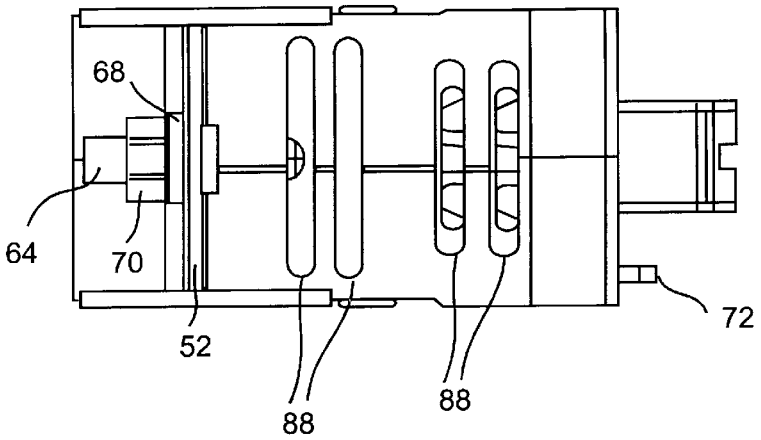
FIG. 5 is an end view of the disconnect device of the present invention.

As best seen in FIG. 3, the alarm fuse 72 is wired to the lugs 52, 54, and a contact 86 with wires 90, 92, and 94.

Each of the housing halves includes a plate 78, 80 which has formed therein a recess 79 for accommodating at least a portion of the load lug 52 so that the lug 52 is secured within the housing 38.

In view of the fact that the present invention may be used in high current situations, ventilation slots 88 may be provided at various locations on the main housing 38.

Rivets 82 are inserted through apertures 84 and are used to retain the housing halves together in the final assembled position. Alternatively, other forms of securing the housing halves together, such as adhesives or welding may be used instead of the rivets.

The main housing 38 may also be made of any acceptable material, which can be determined by one of skill in the appropriate art. In a preferred embodiment, the material from which the main housing is made is also RYNITE® FR515, available from the DuPont Corporation of Wilmington, Del.

Only the preferred embodiments are specifically illustrated and disclosed herein. It should be appreciated that numerous modifications and variations of the present invention are possible in light of the above teachings and within the preview of the appended claims, without departing from the scope and intended spirit of the invention.

What is claimed is:

1. A power supply disconnect device for installation in a power supply distribution panel having at least one power supply bus, the disconnect device comprising:

a main housing that fits within the power supply distribution panel;

a receptacle in the main housing;

a detachable fuse holder that fits within the main housing receptacle; and first electrical contacts within the main housing that are engagable with a fuse in the fuse holder when the fuse holder is inserted in the main housing receptacle;

the fuse holder includes two parts that are moveable relative to each other, and which can be moved into an open position for receiving the fuse and into a closed position for securing the fuse in the fuse holder.

2. The disconnect device of claim 1, wherein the first electrical contacts engage directly with the fuse when the fuse holder is inserted in the main housing.

3. The disconnect device of claim 1, further comprising a clasp on the fuse holder to maintain the fuse holder in the closed position.

4. The disconnect device of claim 1, wherein the fuse holder includes two opposite end walls, each of the end walls includes a bracket for securing a respective blade of the fuse when the fuse holder is in the closed position.

5. The disconnect device of claim 1, wherein the fuse is a knife blade type fuse rated for 70 to 250 amps, and which includes blade contacts.

6. The disconnect device of claim 5, wherein each of the first electrical contacts have two parallel blades that directly engage the fuse blade contacts, and further includes a spring passing through an aperture in a base of the parallel blades to bias the parallel blades together.

7. The disconnect device of claim 6, wherein each spring engages in a recess on each of the parallel blades.

8. The disconnect device of claim 1, further comprising second electrical contacts on the main housing that are connected to the first electrical contacts and which are for connection to the power supply distribution panel.

9. The disconnect device of claim 1, wherein the two parts of the fuse holder are pivotably connected so that the two parts can be moved into said open position without completely separating the two parts.

10. The disconnect device of claim 9, wherein each of the two parts includes brackets for locking blades of the fuse when the fuse holder is closed.

11. A power supply disconnect device for installation in a power supply distribution panel having at least one power supply bus, the disconnect device comprising:

a main housing that fits within the power supply distribution panel;

a receptacle in the main housing;

a fuse holder that fits within the main housing receptacle, said fuse holder includes two parts that are moveable relative to each other, and which can be moved into an open position for receiving the fuse and into a closed position for securing the fuse in the fuse holder;

first electrical contacts within the main housing that are engagable with a fuse in the fuse holder when the fuse holder is inserted in the main housing receptacle; and an alarm fuse connected to the first electrical contacts so as to provide an alarm in the event that a fuse in the fuse holder is opened, the alarm fuse being located in the receptacle in the main housing.

12. The disconnect device of claim 11, wherein the fuse holder includes a recess for accommodating the alarm fuse.

13. The disconnect device of claim 11, wherein the alarm fuse provides both local and remote indication of an opened fuse.

14. The disconnect device of claim 11, wherein the first electrical contacts engage directly with the fuse when the fuse holder is inserted in the main housing.

15. The disconnect device of claim 11, wherein the fuse is a knife blade type fuse rated for 70 to 250 amps, and which includes blade contacts.

16. The disconnect device of claim 15, wherein each of the first electrical contacts have two parallel blades that directly engage the fuse blade contacts, and further includes a spring passing through an aperture in a base of the parallel blades to bias the parallel blades together.

17. The disconnect device of claim 16, wherein each of the springs engages in a recess on each of the parallel blades.

18. The disconnect device of claim 11, wherein the fuse is a knife blade type fuse rated for 70 to 250 amps.

19. The disconnect device of claim 11, further comprising second electrical contacts on the main housing that are connected to the first electrical contacts and which are for connection to the power supply distribution panel.

* * * * *

UNITED STATES PATENT AND TRADEMARK OFFICE

CERTIFICATE OF CORRECTION

PATENT NO : 5,963,411

DATED : October 5, 1999

INVENTOR(S) : Mollet et al.

It is certified that error appears in the above-identified patent and that said Letters Patent is hereby corrected as shown below:

On the Title Page, item [54], in the title, delete "FOCUSED" and insert therefor --FUSED--.

Signed and Sealed this

Twenty-third Day of January, 2001

*Attest:*

*Attesting Officer*

Q. TODD DICKINSON

*Commissioner of Patents and Trademarks*